US007419437B2

(12) United States Patent
Boll et al.

(10) Patent No.: US 7,419,437 B2
(45) Date of Patent: Sep. 2, 2008

(54) SWING AND SWING PACKAGING ARRANGEMENT

(75) Inventors: Christopher D. Boll, Janesville, WI (US); Brian K. Zeilinger, Janesville, WI (US)

(73) Assignee: PlayStar, Inc., Janesville, WI (US)

( * ) Notice: Subject to any disclaimer, the term of this patent is extended or adjusted under 35 U.S.C. 154(b) by 401 days.

(21) Appl. No.: 11/043,662

(22) Filed: Jan. 26, 2005

(65) Prior Publication Data

US 2006/0163918 A1 Jul. 27, 2006

(51) Int. Cl.
*A63G 9/16* (2006.01)
*A63G 9/00* (2006.01)

(52) U.S. Cl. ..... 472/120; 472/118; 472/125; 297/244

(58) Field of Classification Search ..... 472/118–125, 472/108, 111, 112; 297/244
See application file for complete search history.

(56) References Cited

U.S. PATENT DOCUMENTS

| | | | | |
|---|---|---|---|---|
| 555,981 | A | | 3/1896 | Streeter |
| 1,657,243 | A | | 1/1928 | Daniels |
| 1,939,223 | A | | 12/1933 | Palmer |
| 2,059,777 | A | * | 11/1936 | Denney ..... 472/120 |
| 2,517,207 | A | * | 8/1950 | Hugueny ..... 472/120 |
| 2,823,002 | A | | 2/1958 | Savitz |
| 3,145,013 | A | | 8/1964 | Grudoski |
| 3,391,932 | A | | 7/1968 | Scalf |
| 3,447,802 | A | | 6/1969 | Gudoski |
| 3,503,582 | A | | 3/1970 | Boucher |
| 3,782,724 | A | | 1/1974 | Rottman et al. |
| 4,018,538 | A | | 4/1977 | Smyrni et al. |
| 4,155,548 | A | | 5/1979 | Smith et al. |
| 4,961,558 | A | | 10/1990 | Cunard |
| 4,991,716 | A | | 2/1991 | Havlovitz |
| 5,326,326 | A | | 7/1994 | Cunard et al. |
| 5,393,268 | A | | 2/1995 | Cunard et al. |
| 6,039,654 | A | | 3/2000 | Zeilinger |
| D422,332 | S | | 4/2000 | Zeilinger |
| D424,154 | S | | 5/2000 | Zeilinger |
| D424,649 | S | | 5/2000 | Hilliker |
| 6,068,557 | A | | 5/2000 | Zeilinger |
| D428,637 | S | | 7/2000 | Zeilinger |
| 6,302,801 | B1 | | 10/2001 | Zeilinger |
| 6,544,930 | B2 | | 4/2003 | Wright |
| 6,790,244 | B2 | | 9/2004 | Saunders et al. |

OTHER PUBLICATIONS

Admitted Prior Art Adventure- swing (Date Unknown), pp. 1-3.
Admitted Prior Art Swing-N-Slide EZ Ryder swing and box (Date Unknown), pp. 1-5.
Admitted Prior Art Swing-N-Slide Mega Ryder swing and box (Date Unknown), pp. 1-9.

(Continued)

*Primary Examiner*—Kien T Nguyen
(74) *Attorney, Agent, or Firm*—Michael Best & Friedrich LLP

(57) ABSTRACT

A swing ride includes a plastic seat portion, a first plastic hand rest and foot rest portion configured to be coupled to a first end of the seat portion, and a second plastic hand rest and foot rest portion configured to be coupled to a second end of the seat portion. The swing ride in a disassembled state is configured to be received in a container having a volume of less than 5,760 cubic inches.

17 Claims, 8 Drawing Sheets

OTHER PUBLICATIONS

Admitted Prior Art Creative Playthings swing and box (Date Unknown), pp. 1-2.
Admitted Prior Art Playstar Bronco Rider swing and box and pallet arrangement, pp. 1-3.
Admitted Prior Art Hedstrom Rocket Rider swing (Date Unknown), pp. 1-2.
Admitted Prior Art Hedstrom Rocket Rider and Star Cruiser swings (Date Unknown), p. 1.

* cited by examiner

SWING AND SWING PACKAGING ARRANGEMENT

FIELD OF THE INVENTION

The invention relates to children's playground equipment, and more particularly to swing rides for playground equipment.

BACKGROUND OF THE INVENTION

Two-person swing rides are a favorite item for use with children's playstations. The swing rides are typically hung from a playstation on one or more link-type chains, ropes, or other suitable members, and allow two children to ride the swing together. Most two-person swing rides are currently made primarily from wood parts, metal parts, plastic parts, or a combination of wood, metal, and plastic parts.

SUMMARY OF THE INVENTION

Rides made of all plastic parts (with the exception of mounting and assembly hardware) are favored over rides made with wood or metal parts because the plastic parts are generally much lighter in weight. Additionally, plastic parts are more weather-resistant and require less maintenance, thereby prolonging the life of swing rides made from plastic. Molded plastic parts are also often more comfortable for the rider. However, the plastic parts are typically large and bulky, and require packaging in large boxes. The large boxes increase the packaging costs, shipping costs, and storage costs associated with the rides.

The present invention provides an improved two-person swing ride that provides all the advantages of an all-plastic ride, yet is designed such that the disassembled plastic parts can be tightly nested for a significant reduction in volume. Because the nested components of the ride occupy a smaller volume, smaller boxes can be used for packaging.

In one aspect, the invention provides a swing ride including a plastic seat portion, a first plastic hand rest and foot rest portion configured to be coupled to a first end of the seat portion, and a second plastic hand rest and foot rest portion configured to be coupled to a second end of the seat portion. The swing ride in a disassembled state is configured to be received in a container having a volume of less than 5,760 cubic inches. In one embodiment, the swing ride in a disassembled state is configured to be received in a container having a volume of about 3,200 cubic inches.

In another aspect, the invention provides a swing ride including a plastic seat portion and a first plastic hand rest and foot rest portion coupled to a first end of the plastic seat portion. The first plastic hand rest and foot rest portion includes a first plastic base member, a first plastic foot rest member coupled to the first plastic base member for receiving a first rider's feet, and a first plastic hand rest member coupled to the first plastic base member for receiving the first rider's hands. The swing ride also includes a second plastic hand rest and foot rest portion coupled to a second end of the plastic seat portion and including a second plastic base member, a second plastic foot rest member coupled to the second plastic base member for receiving a second rider's feet, and a second plastic hand rest member coupled to the second plastic base member for receiving the second rider's hands.

In yet another aspect, the invention provides the swing ride in a disassembled state. The components of the swing ride are arranged in nested relation with the first and second base members positioned on opposite sides of the seat portion, and the first and second foot rest members and the first and second hand rest members being positioned at least partially on the seat portion.

Other features and advantages of the invention will become apparent to those skilled in the art upon review of the following detailed description, claims, and drawings.

Figure 1:
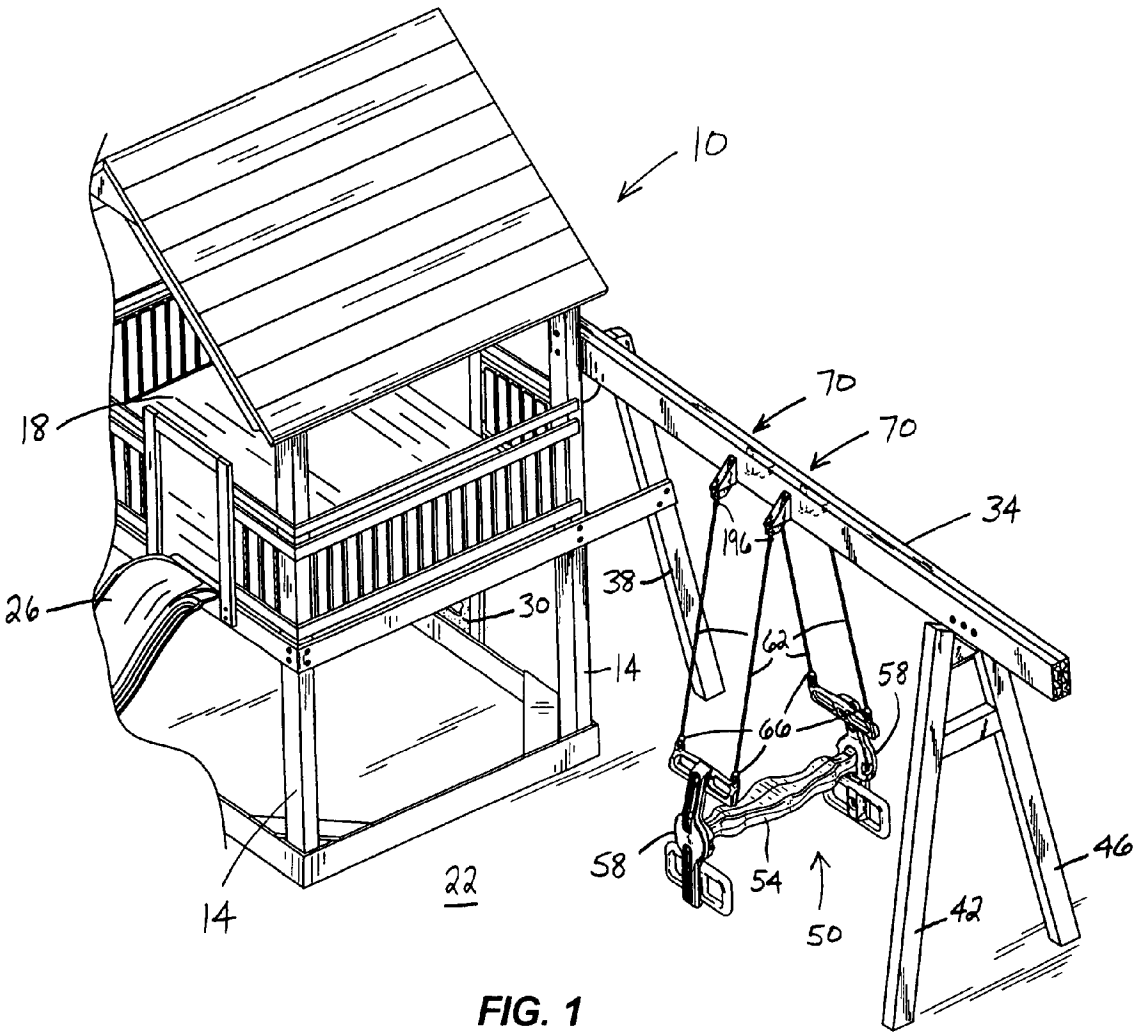
FIG. 1 is a partial perspective view of a playstation including a swing ride embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including", "having" and "comprising" and variations thereof herein is meant to encompass the items listed thereafter and equivalents thereof as well as additional items.

DETAILED DESCRIPTION

FIG. 1 illustrates a playstation 10 of the type typically used by children for recreational play. The playstation 10 includes a plurality of legs 14 that support an elevated support structure or platform 18 above a lower support surface, such as the ground 22. As shown, a slide 26 may be coupled to the playstation 10 to allow children to slide from the platform 18 down to the ground 22. A climbing panel or ladder 30 is coupled to the playstation 10 to provide a way for children to climb from the ground 22 up to the platform 18. Of course, other configurations of ladders, steps, or climbing panels can also be used.

A support member in the form of a beam 34 is coupled to one of the legs 14 and extends away from the platform 18. In the illustrated embodiment, a first support leg 38 is coupled to the end of the beam 34 adjacent the platform 18. Second and third support legs 42, 46, respectively, are coupled to the end of the beam 34 that is spaced from the platform 18. The support legs 38, 42, and 46 can be coupled to the support beam 34 in any suitable manner. In the illustrated embodiment, the support legs 38, 42, and 46 are connected to the support beam 34 using brackets of the type disclosed in U.S. Pat. Nos. 6,039,654 and 6,302,801 assigned to PlayStar, Inc. and hereby incorporated by reference.

As shown in FIG. 1, the support beam 34 supports a swing ride 50 configured to be ridden by two children. Additionally, while not shown, other rides and climbing features (e.g., rings, monkey bars, etc.) can also be coupled to the playstation 10.

The swing 50 generally includes a plastic seat portion 54 and two plastic hand rest/foot rest portions 58 coupled to opposite ends of the seat portion 54. The illustrated seat portion 54 and the components of the hand rest/foot rest portions 58 are molded from a suitable plastic using a conventional blow molding technique. Of course, other suitable molding techniques (e.g., rotational molding) can also be used.

The illustrated swing 50 is supported by four elongated support members in the form of chains 62 that are connected to the hand rest/foot rest portions 58 as shown. Quick link connectors 66 can be incorporated into the chains 62 to facilitate changing the swing 50 to another similar type of swing. Of course, ropes, cables, and other elongated support members can be substituted for the chains 62 as desired.

In the illustrated embodiment, the chains 62 are coupled to the support beam 34 via a mounting system in the form of two swing bracket assemblies 70 that are mounted to the support beam 34. The mounting system is described in detail in copending U.S. patent application Ser. No. 11/016,170, filed Dec. 17, 2004, which is hereby incorporated by reference.

Figure 2:
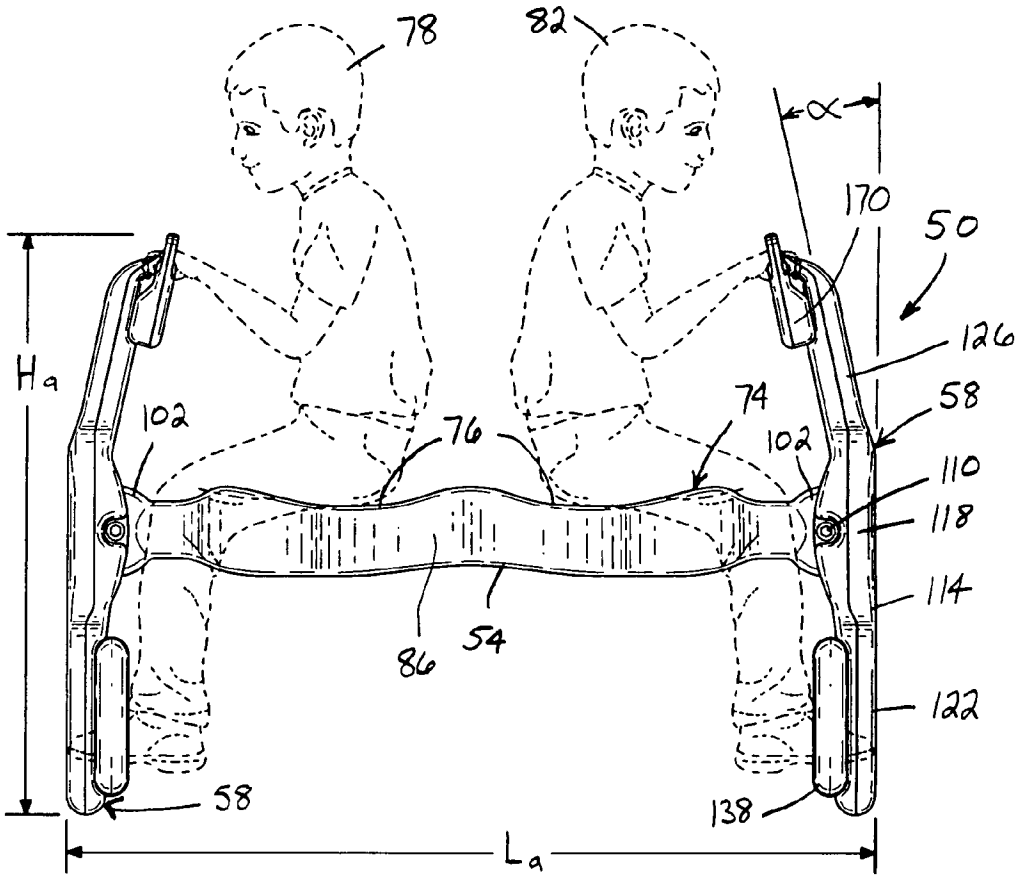
FIG. 2 is an enlarged side view of the swing ride of FIG. 1.
Figure 3:
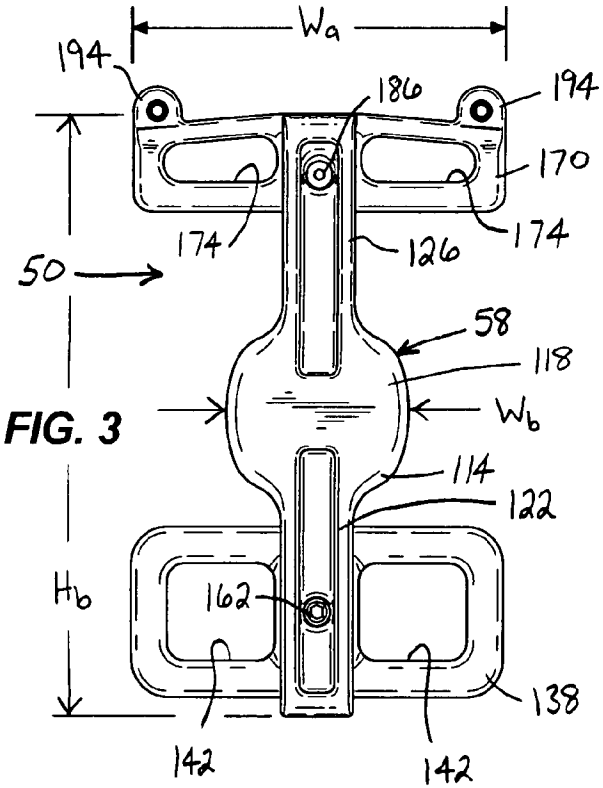
FIG. 3 is an enlarged front view of the swing ride.
Figure 4:
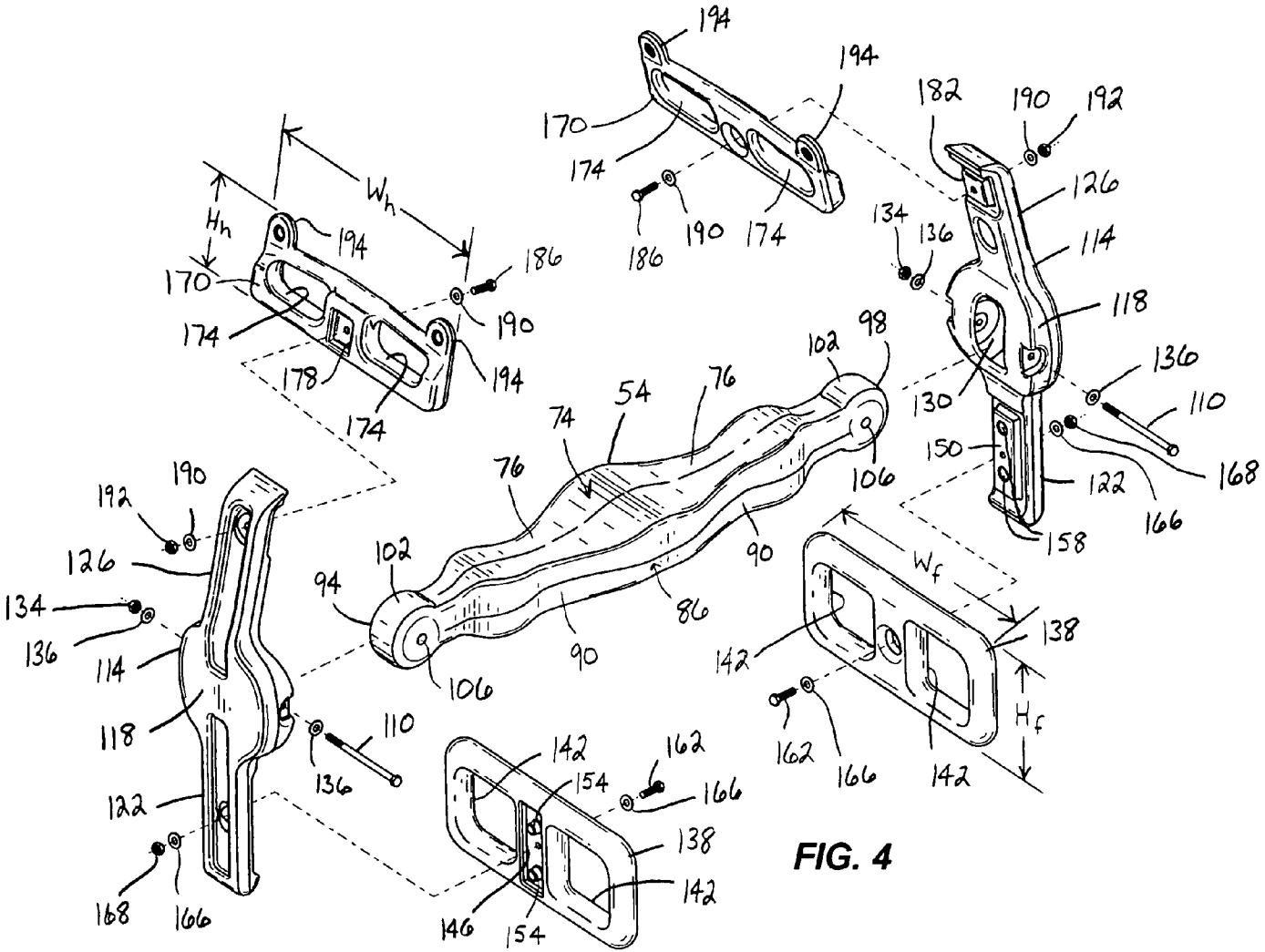
FIG. 4 is an exploded view of the swing ride.

FIGS. 2-4 illustrate the swing 50 in more detail. The seat portion 54 includes an upper surface 74 that includes two concavely-contoured seating portions 76 to comfortably support first and second swing riders 78 and 82, as shown in FIG. 2. The seat portion 54 also includes oppositely facing side surfaces 86. Each side surface 86 is contoured with two concave portions 90 (see FIGS. 4 and 7) that facilitate packaging the disassembled swing 50 components, as will be described in greater detail below.

The seat portion 54 also includes first and second ends 94, 98, respectively. Each end 94, 98 includes a generally cylindrical ball joint 102 configured to couple the seat portion 54 to other components of the swing 50, as will be described below. Each ball joint 102 includes an aperture 106 (see FIG. 4) for receiving a fastener 110 therethrough.

The two hand rest/foot rest portions 58 are substantially identical, with like reference numerals indicating like parts. Each hand rest/foot rest portion 58 includes a plastic arm or base member 114 having a central hub portion 118 and oppositely extending arm portions 122 and 126. The hub portion 118 includes a recess 130 (see FIG. 4) defining a socket configured to receive a respective ball joint 102 of the seat portion 54 and to pivotally connect the base member 114 to the seat portion 54. The fastener 110, along with a nut 134 and washers 136, pivotally couple the base member 114 to the seat portion 54.

As best seen in FIG. 2, the base member 114 includes a bend between the hub portion 118 and the arm portion 126. The bend defines an angle $\alpha$ of between about five to fifteen degrees, and in the illustrated embodiment is about ten degrees. The bend makes the swing 50 more comfortable for the riders, and allows the user's feet and hands to be generally in line with the pivot point of the base member 114, i.e., the fastener 110. This alignment facilitates a smooth and comfortable "rhythmic" action of the hand rest/foot rest portions 58 by the users. Additionally, as will described in greater detail below, the bend formed in the base member 114 facilitates the packaging of the disassembled swing ride 50.

Referring now to FIG. 3, at its widest point adjacent the hub portion 118, the base member 114 has a width $W_b$ of about 7.6 inches, and then narrows at the arm portions 122 and 126. The height $H_b$ of the base member 114 is about 24.7 inches. At its thickest point adjacent the recess 130 in the hub portion 118, the base member 114 has a thickness of about 4.2 inches, and then narrows toward the arms portions 122 and 126. By molding the base member 114 from resin, the above-described configuration for the base member 114 can be readily achieved.

Each hand rest/foot rest portion 58 further includes a plastic foot rest member 138 configured to be coupled to the arm 122 below the seat portion 54 for supporting the feet of the rider. In the illustrated embodiment, the foot rest members 138 are generally rectangular in shape and define two apertures 142 for receiving the feet of the riders 78, 82 (see FIG. 2). While the illustrated embodiment includes two apertures 142 per foot rest member 138, a single, larger aperture could also be used. As shown in FIG. 4, each foot rest member 138 has a height $H_f$ of about 7.0 inches and a width $W_f$ of about 15.5 inches. In the illustrated embodiment, the foot rest member 138 has a thickness of about 1.5 inches.

To facilitate the connection of the foot rest members 138 to the respective base members 114, each foot rest member 138 includes a recess 146 (see FIG. 4) configured to receive a mating projection 150 formed on the arm 122 of the base member 114. In the illustrated embodiment, the recess 146 and projection 150 are generally rectangular in shape, and when engaged, substantially prevent rotation between the foot rest member 138 and the base member 114. Of course, other shapes for the recess 146 and projection 150 could be substituted, and the projection 150 and recess 146 could be reversed so that the projection is formed on the foot rest member 138 and the recess is formed in the base member 114. Additionally, two generally cylindrical projections 154 (see FIG. 4) are formed within the recess 146 to be received in mating apertures 158 formed in the projection 150. These features facilitate engaging and anti-rotating the foot rest member 138 with respect to the base member 114. With this construction, a single fastener 162, and the associated washers 166 and nut 168, can be used to couple each foot rest member 138 to its respective base member 114.

Each hand rest/foot rest portion 58 also includes a plastic hand rest member 170 configured to be coupled to the arm 126 above the seat portion 54 and to allow the rider to grasp the hand rest member 170. In the illustrated embodiment, the hand rest members 170 are generally rectangular in shape and define two apertures 174 for receiving portions of the hands of the riders 78, 82 (see FIG. 2). While the illustrated embodiment includes two apertures 174 per foot hand member 170, a single, larger aperture could also be used. As shown in FIG. 4, each hand rest member 170 has a height $H_h$ of about 5.2 inches and a width $W_h$ of about 15.5 inches. In the illustrated embodiment, the hand rest member 170 has a thickness of about 1.5 inches.

To facilitate the connection of the hand rest members 170 to the respective base members 114, each hand rest member 170 includes a recess 178 (see FIG. 4) configured to receive a mating projection 182 formed on the arm 126 of the base member 114. In the illustrated embodiment, the recess 178 and projection 182 are generally square in shape. When engaged, these features substantially prevent rotation between the hand rest member 170 and the base member 114. Of course, other shapes for the recess 178 and projection 182 could be substituted, and the projection 182 and recess 178 could be reversed so that the projection is formed on the hand rest member 170 and the recess is formed in the base member 114. With this construction, a single fastener 186, and the associated washers 190 and nut 192, can be used to couple each hand rest member 170 to its respective base member 114.

Each hand rest member 170 further includes integral tabs or ears 194 configured to be connected to the chains 62. Unlike with some prior art swing rides in which the chains or support members are secured to the ride at a point well below the hand rests, the tabs 194 provide a wide mounting arrangement that improves the stability of the swing ride 50. In the illustrated embodiment, the quick links 66 couple the chains 62 to the tabs 194 (see FIG. 1).

The swing 50 includes seven plastic components—namely the seat portion 54, two base members 114, two foot rest members 138, and two hand rest members 170—that are interconnected by fasteners 110, 162, and 186. With reference to FIGS. 2 and 3, the assembled swing has an overall height $H_a$ of at least about 25 inches, an overall length $L_a$ of at least about 36 inches, and an overall width $W_a$ of at least about 15 inches. In the illustrated embodiment, the assembled swing has an overall height $H_a$ of about 25.7 inches, an overall length $L_a$ of about 36.4 inches, and an overall width $W_a$ of about 15.5 inches.

Prior art two-person swing rides having plastic seat portions and plastic hand rest/foot rest portions are known, and such rides have commonly been formed of only three plastic components, i.e., a plastic seat and two integrally-formed, plastic hand rest/foot rest portions. While such constructions require fewer steps to assemble than the swing 50 of the present invention, they include bulkier components that occupy a larger volume when disassembled, thereby requiring a larger container for packaging and shipping. Known prior art swing rides of this type have typically been packaged in boxes having volumes of 5,760 cubic inches or greater. The packaging, shipping, and storage costs of such prior art swings are therefore substantial.

The swing 50 of the present invention, while including more separate plastic components than prior art plastic swings, is designed to significantly reduce packaging, shipping, and storage costs by being configured to occupy a much smaller volume in a disassembled state. More specifically, the disassembled swing 50 of the present invention is configured to be received in a container having a volume of less than 5,760 cubic inches, and as will be described below, is configured to be received in a container having a volume as small as about 3,200 cubic inches. Notwithstanding this reduction in packaged volume, the assembly of the swing ride remains comparable to prior art rides, and the overall assembled dimensions of the swing ride 50 are comparable to the assembled dimensions of prior art swing rides.

Figure 5:
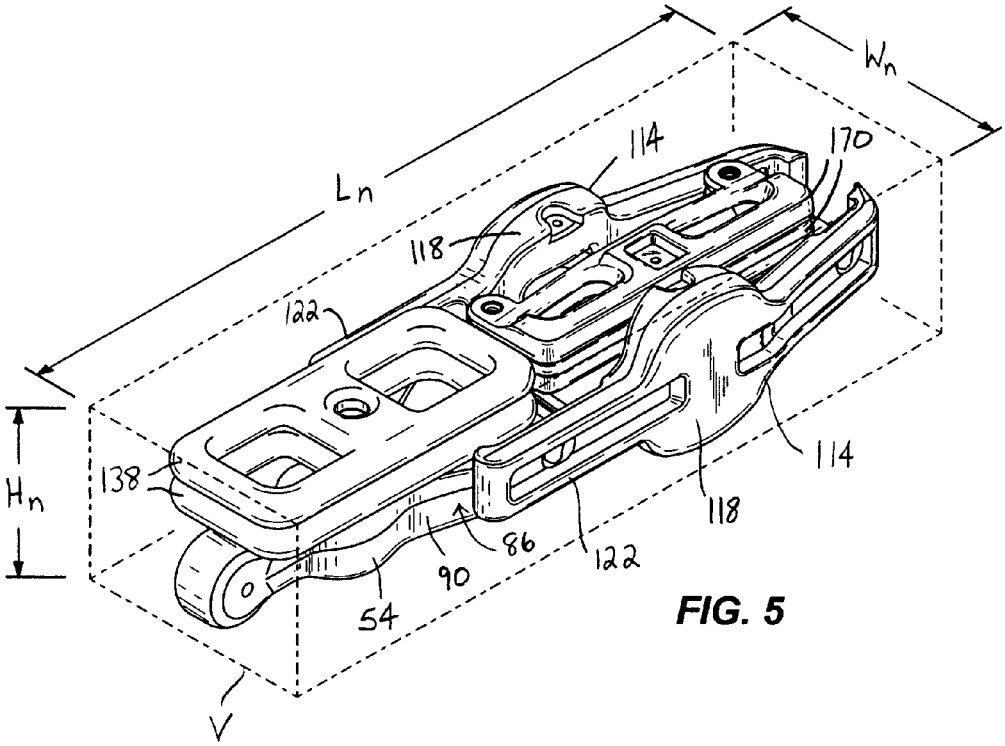
FIG. 5 is a perspective view illustrating components of the disassembled swing ride in a nested configuration.
Figure 6:
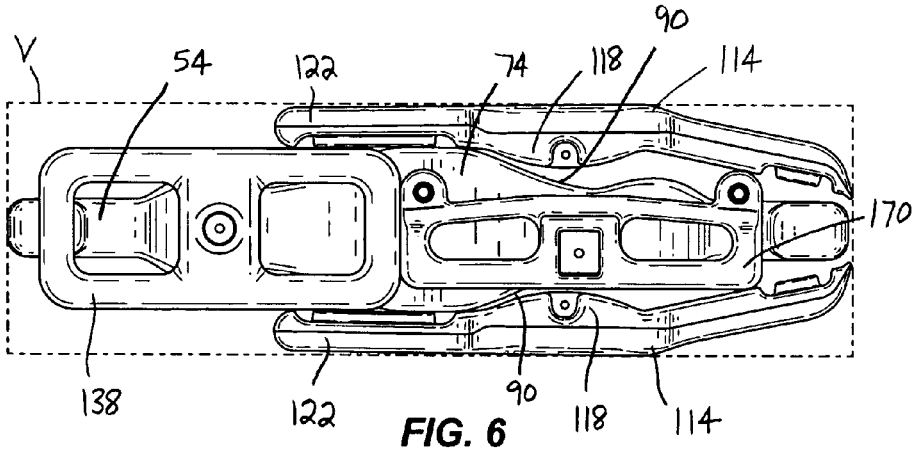
FIG. 6 is a top view of the nested swing ride components.

FIGS. 5 and 6 illustrate a nested configuration of the seven plastic components of the swing 50. The base members 114 are positioned on opposite sides of the seat portion 54 such that the hub portions 118 are at least partially received in a respective one of the concave portions 90 in the side surfaces 86 of the seat portion 54. This enables the base members 114 to fit tightly along the side surfaces 86 of the seat portion 54. The bend in the base members 114 further facilitates the tight nesting of the base members 114 against the side surfaces 86 of the seat portion 54. The hand rest members 170 are positioned at least partially on the seat portion 54 in stacked relation between the two base members 114. The foot rest members 138 are also positioned at least partially on the seat portion 54 in stacked relation. In the illustrated nested configuration, the foot rest members 138 are positioned partially between the two base members 114, and more specifically are partially between only the arms 122 of the base members 114.

In the nested configuration shown in FIGS. 5 and 6, the seven plastic components of the swing 50 occupy a volume V of less than or equal to about 3,200 cubic inches. As illustrated, the volume V is about 3,168 cubic inches. The nested components have an overall nested height $H_n$ of less than or equal to about 7.7 inches, an overall nested length $L_n$ of less than or equal to about 36 inches, and an overall nested width $W_n$ of less than or equal to about 10.8 inches. As illustrated, the nested components have an overall nested height $H_n$ of about 7.63 inches, an overall nested length $L_n$ of about 36.00 inches, and an overall nested width $W_n$ of about 10.72 inches. In this nested configuration, the seven plastic components of the swing 50, as well as the fasteners, washers, and nuts for assembling the seven plastic components can be packaged in a container having a volume of less than or equal to about 3,200 cubic inches. This is a significant reduction in package size for an all-plastic (except for the assembly hardware), two-person swing ride.

The ratios between assembled dimensions and disassembled, nested dimensions are as follows:

$H_a$ to $H_n \approx 3.2$ $L_a$ to $L_n \approx 1$ $W_a$ to $W_n \approx 1.4$

FIGS. 7-12 illustrate one possible packaging configuration in which the seven plastic components of the swing 50, the assembly hardware for the plastic components, and the mounting hardware for the swing 50, in the form of the bracket assemblies 70, the chains 62, the quick links 66, and the swing hangers 196 (see FIG. 1), are packed in a single container 200.

Figure 7:
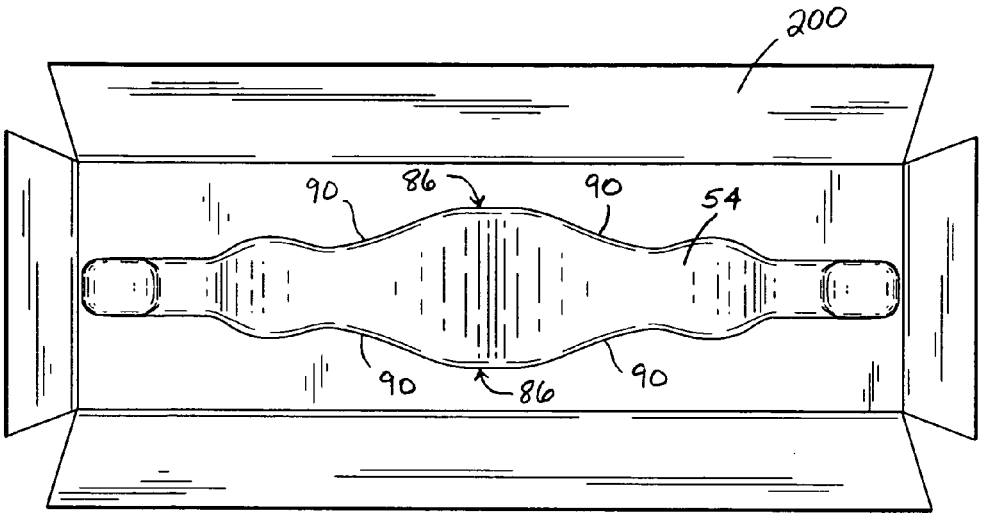
FIGS. 7-12 illustrate the steps used for packaging the disassembled swing ride.
Figure 8:
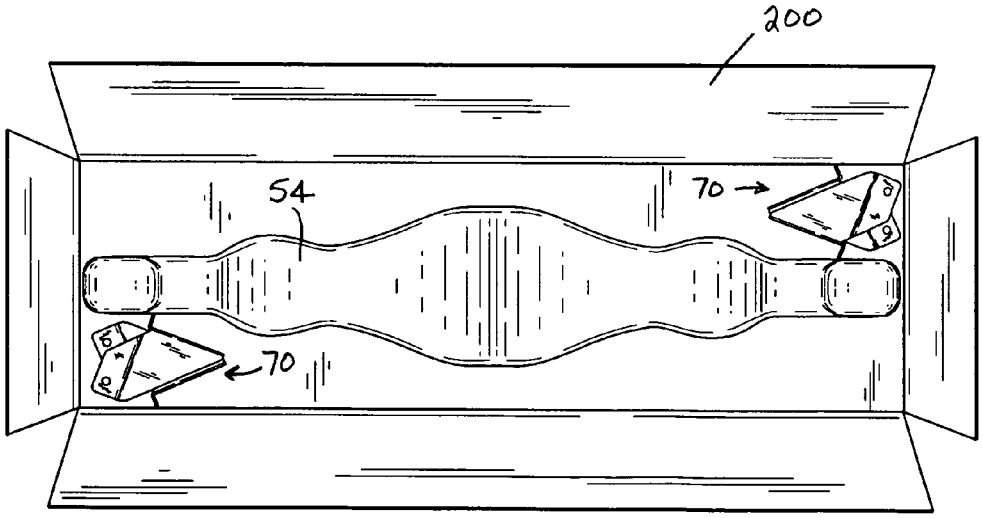
Figure 9:
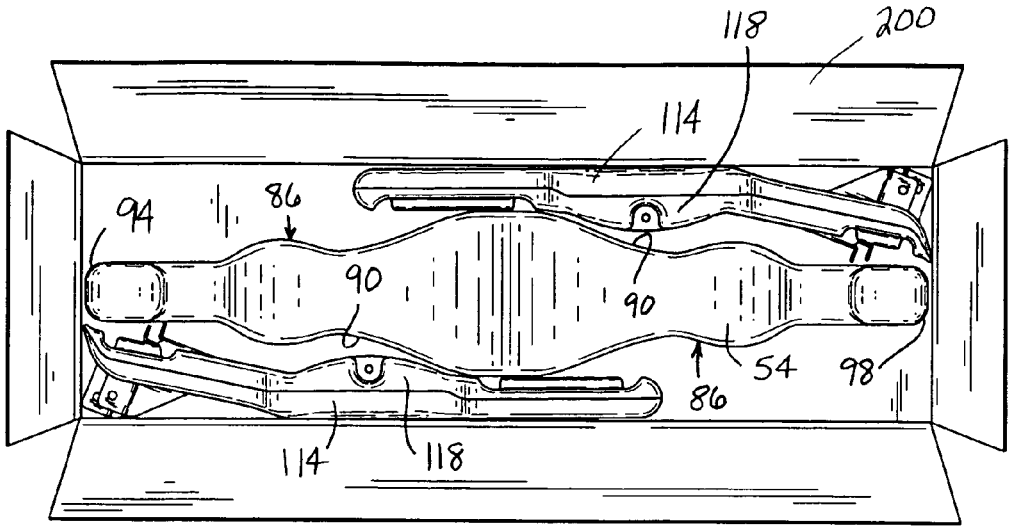

FIG. 7 illustrates the seat portion 54 placed into the container 200. In FIG. 8, two pairs of brackets from the bracket assemblies 70 are positioned in diametrically-opposed corners of the container 200. In FIG. 9, the base members 114 are placed on opposite sides of the seat portion 54. Instead of being positioned as shown in FIGS. 5 and 6, one of the base members 114 is positioned closer to the first end 94 of the seat portion 54 and the other base member 114 is positioned closer to the second end 98 of the seat portion 54 in diametrically opposed relation. This arrangement helps to evenly distribute the weight within the container 200. Note, however, that each hub portion 118 is at least partially received in a concave portion 90 of the side surfaces 86 to maintain the tightly-nested arrangement of the seat portion 54 and the base members 114. Again, the bend in the base members 114 also facilitates the tightly-nested arrangement of the base members 114 against the side surfaces 86 of the seat portion 54.

Figure 10:
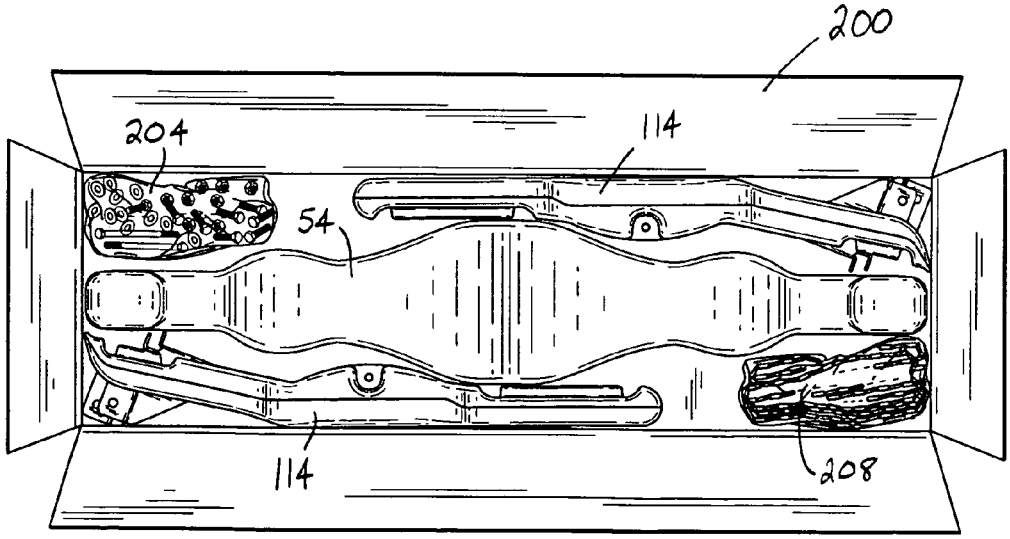
Figure 11:
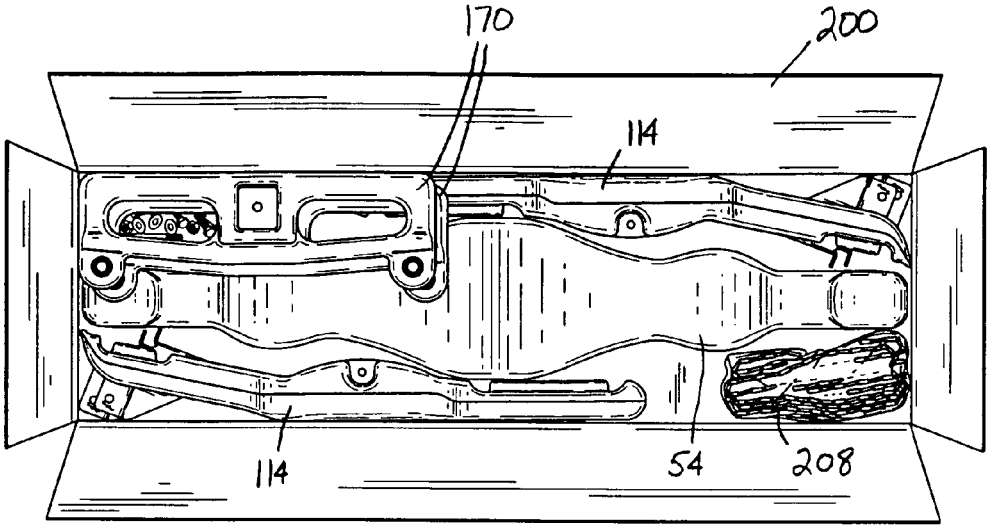
Figure 12:
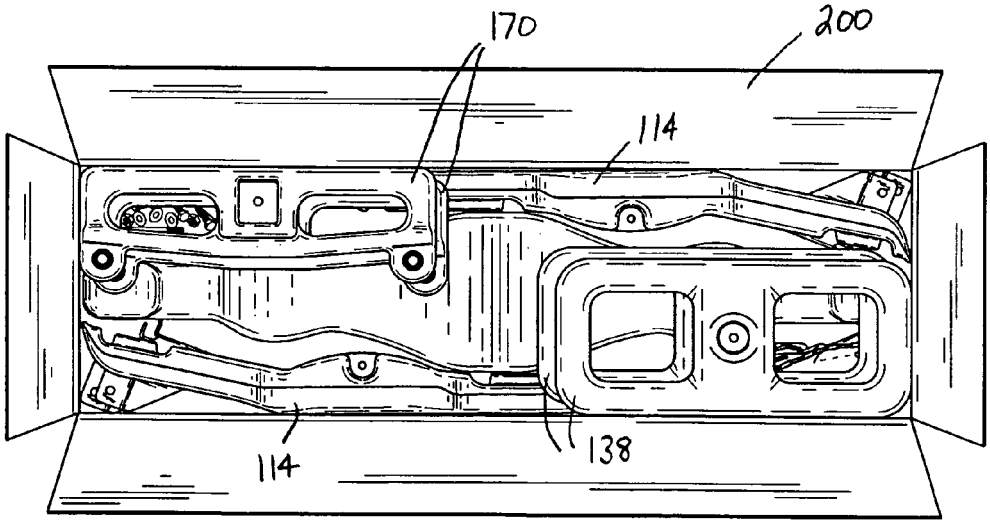

FIG. 10 illustrates the placement of the assembly hardware bag 204 (including the fasteners 110, 162, 186, washers 136, 166, 190, nuts 134, 168, 192, and additional hardware for mounting the brackets of the bracket assemblies 70) and the mounting hardware bag 208 (including the chains 62, the quick links 66, and the swing hangers 196) in the container 200 at diametrically-opposed corners. This arrangement also helps to evenly distribute the weight within the container 200. Next in FIGS. 11 and 12, the foot rest members 138 and the hand rest members 170 are positioned in stacked relation at least partially on the seat portion 54 and in diametrically-opposed corners of the container 200 as shown. While the illustrated embodiment shows the two foot rest members 138 stacked on one another, and the two hand rest members 170 stacked on one another, it is understood that alternatively one hand rest member 170 could be stacked on one foot rest member 138, or vice versa.

Figure 13:
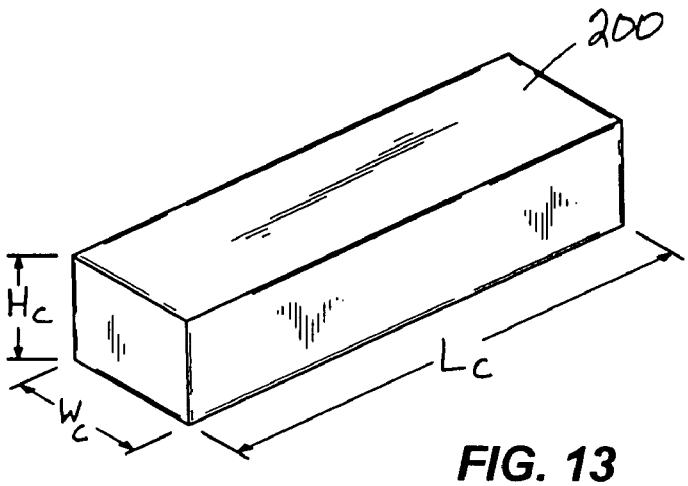
FIG. 13 is a perspective view of the container in which the swing ride is packaged.

In the illustrated embodiment, and as shown in FIG. 13, the container 200 takes the form of a cardboard box having a length $L_c$ of less than or equal to about 36.25 inches, a height $H_c$ of less than or equal to about 8 inches, and a width $W_c$ of less than or equal to about 11 inches, thereby providing an overall volume $V_c$ of the container 200 of less than or equal to about 3,200 cubic inches, and more specifically of less than or equal to about 3,190 cubic inches. The illustrated container 200 therefore has a significantly-reduced volume from previously-used containers housing prior art, all-plastic swing rides, yet still houses all of the swing ride components, assembly hardware, and mounting hardware. Prior art swing ride containers for all-plastic swing rides typically had volumes of at least 5,760 cubic inches. With the all-plastic swing ride 50 and the container 200 of the present invention, the percent volume reduction from prior art swing ride containers housing all-plastic swing rides is at least about forty-four percent.

The ratios between assembled dimensions and packaged dimensions are as follows:

$H_a$ to $H_c \approx 3.2$ $L_a$ to $L_c \approx 1$ $W_a$ to $W_c \approx 1.4$

Figure 14:
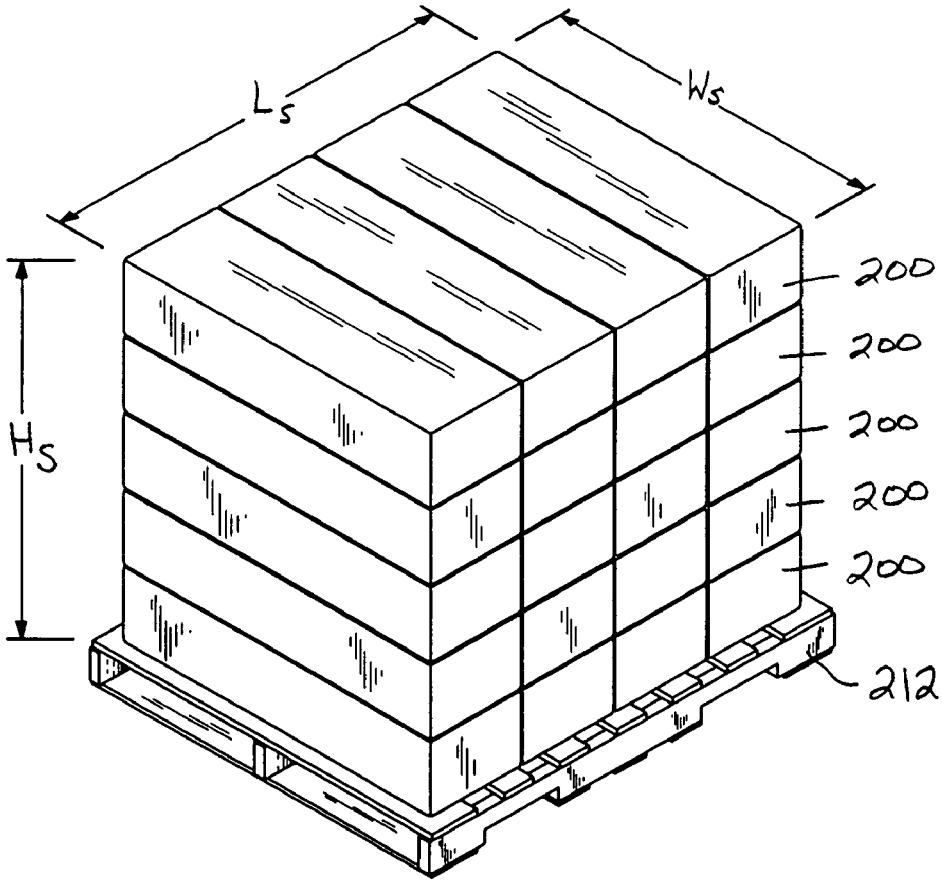
FIG. 14 is a perspective view of a palletized stack of containers.

As shown in FIG. 14, the illustrated container 200 is sized and configured to facilitate stacking on a shipping pallet 212. The illustrated pallet 212 is a conventional forty inch by forty-eight inch pallet that can support twenty stacked containers 200 to have a stacked height $H_s$ of less than or equal to about 40 inches, a stacked length $L_s$ of less than or equal to about 44 inches, and a stacked width $W_s$ of less than or equal to about 36.25 inches, and to provide an overall stacked volume $V_s$ of less than or equal to about 63,800 cubic inches.

The swing ride 50 of the present invention provides all of the comforts and benefits of an all-plastic swing ride, yet significantly reduces the packaged volume of the swing ride components, thereby reducing packing, shipping and storage costs associated with the swing ride 50. In achieving this goal, the swing ride 50 includes more separate plastic components than prior art all-plastic swing rides. In a somewhat counter-intuitive manner, increasing the number of parts results in a decrease in packaged volume. However, the components of the swing ride 50 are designed for quick and easy assembly, such that the increased number of parts does not substantially increase the assembly time and effort.

Various features of the invention are set forth in the following claims.

The invention claimed is:

1. A swing ride comprising:

a plastic seat portion;

a first plastic hand rest and foot rest portion coupled to a first end of the plastic seat portion and including, a first plastic base member;

a first plastic foot rest member coupled to the first plastic base member for receiving a first rider's feet; and a first plastic hand rest member coupled to the first plastic base member for receiving the first rider's hands; and a second plastic hand rest and foot rest portion coupled to a second end of the plastic seat portion and including, a second plastic base member;

a second plastic foot rest member coupled to the second plastic base member for receiving a second rider's feet; and a second plastic hand rest member coupled to the second plastic base member for receiving the second rider's hands;

wherein each base member includes at least one of a protrusion or a recess configured to engage a mating protrusion or recess formed in the respective foot rest member to substantially prevent relative rotation between the coupled base member and foot rest member.

2. The swing ride of claim 1, wherein each foot rest member includes at least one aperture for receiving a rider's feet.

3. The swing ride of claim 1, wherein each hand rest member includes at least one aperture for receiving a rider's hands.

4. The swing ride of claim 1, wherein each hand rest member includes integrally-formed tabs that define connection points for support members supporting the swing ride.

5. The swing ride of claim 1, wherein each base member includes at least one of a protrusion or a recess configured to engage a mating protrusion or recess formed in the respective hand rest member to substantially prevent relative rotation between the coupled base member and hand rest member.

6. The swing ride of claim 1, wherein each foot rest member and each hand rest member is coupled to the respective base member using only a single fastener.

7. The swing ride of claim 1, wherein each base member includes a bend defining a bend angle of between about five degrees and about fifteen degrees.

8. The swing ride of claim 1, wherein the swing ride is configured to occupy a volume of at least about 13,500 cubic inches when assembled, and wherein the swing ride in a disassembled state is configured to be received in a container having a volume of less than 5,760 cubic inches.

9. The swing ride of claim 8, wherein the swing ride in a disassembled state is configured to be received in a container having a volume of less than 3,200 cubic inches.

10. A swing ride comprising:

a plastic seat portion;

a first plastic hand rest and foot rest portion coupled to a first end of the plastic seat portion and including, a first plastic base member;

a first plastic foot rest member coupled to the first plastic base member for receiving a first rider's feet; and a first plastic hand rest member coupled to the first plastic base member for receiving the first rider's hands; and a second plastic hand rest and foot rest portion coupled to a second end of the plastic seat portion and including, a second plastic base member;

a second plastic foot rest member coupled to the second plastic base member for receiving a second rider's feet; and a second plastic hand rest member coupled to the second plastic base member for receiving the second rider's hands;

wherein each base member includes at least one of a protrusion or a recess configured to engage a mating protrusion or recess formed in the respective hand rest member to substantially prevent relative rotation between the coupled base member and hand rest member.

11. The swing ride of claim 10, wherein each foot rest member includes at least one aperture for receiving a rider's feet.

12. The swing ride of claim 10, wherein each hand rest member includes at least one aperture for receiving a rider's hands.

13. The swing ride of claim 10, wherein each hand rest member includes integrally-formed tabs that define connection points for support members supporting the swing ride.

14. The swing ride of claim 10, wherein each foot rest member and each hand rest member is coupled to the respective base member using only a single fastener.

15. The swing ride of claim 10, wherein each base member includes a bend defining a bend angle of between about five degrees and about fifteen degrees.

16. The swing ride of claim 10, wherein the swing ride is configured to occupy a volume of at least about 13,500 cubic inches when assembled, and wherein the swing ride in a disassembled state is configured to be received in a container having a volume of less than 5,760 cubic inches.

17. The swing ride of claim 16, wherein the swing ride in a disassembled state is configured to be received in a container having a volume of less than 3,200 cubic inches.

* * * * *